US010487382B2

(12) United States Patent
Cha et al.

(10) Patent No.: US 10,487,382 B2
(45) Date of Patent: Nov. 26, 2019

(54) HIGH STRENGTH SPECIAL STEEL

(71) Applicant: Hyundai Motor Company, Seoul (KR)

(72) Inventors: Sung Chul Cha, Seoul (KR); Jong Hwi Park, Suwon-si (KR); Dong Lim Seo, Seoul (KR); Seung Hyun Hong, Seoul (KR)

(73) Assignee: Hyundai Motor Company, Seoul (KR)

( * ) Notice: Subject to any disclaimer, the term of this patent is extended or adjusted under 35 U.S.C. 154(b) by 11 days.

(21) Appl. No.: 15/374,870

(22) Filed: Dec. 9, 2016

(65) Prior Publication Data

US 2018/0073114 A1 Mar. 15, 2018

(30) Foreign Application Priority Data

Sep. 9, 2016 (KR) ..... 10-2016-0116074

(51) Int. Cl.
*C22C 38/54* (2006.01)
*C22C 38/00* (2006.01)
(Continued)

(52) U.S. Cl.
CPC ..... *C22C 38/54* (2013.01); *C22C 38/002* (2013.01); *C22C 38/02* (2013.01); *C22C 38/04* (2013.01);
(Continued)

(58) Field of Classification Search
CPC ..... C22C 38/00; C22C 38/002; C22C 38/02; C22C 38/04; C22C 38/06; C22C 38/54; C22C 38/34; C22C 38/42; C22C 38/44; C22C 38/46; C22C 38/48; C21D 1/00; C21D 1/26; C21D 6/00; C21D 6/001; C21D 6/002; C21D 6/004; C21D 6/005; C21D 6/02; C21D 8/1244; C21D 8/00; C21D 8/005; C21D 8/02; C21D 8/0205; C21D 8/0405; C21D 9/00; C21D 9/46; C21D 2211/00; C21D 2211/004; B21J 1/00; B21J 1/02; B21J 1/06; B21B 45/00; B21C 1/00; B21C 37/00; B21C 37/02
See application file for complete search history.

(56) References Cited

U.S. PATENT DOCUMENTS 4,032,333 A * 6/1977 Josefsson ..... C22C 38/60 420/84
4,796,946 A * 1/1989 Wilson ..... B60J 5/0444 148/333
(Continued)

FOREIGN PATENT DOCUMENTS

EP 0 943 697 A1 9/1999
EP 1 096 031 A2 5/2001
(Continued)

*Primary Examiner* — Alexandra M Moore
(74) *Attorney, Agent, or Firm* — Morgan, Lewis & Bockius LLP

(57) ABSTRACT

Disclosed herein is a high strength special steel including, by weight %: carbon (C): from about 0.1 to 0.5%; silicon (Si): from about 0.1 to 2.3%; manganese (Mn): from about 0.3 to 1.5%; chromium (Cr): from about 1.1 to 4.0%; molybdenum (Mo): from about 0.3 to 1.5%; nickel (Ni): from about 0.1 to 4.0%; vanadium (V): from about 0.01 to 0.50%; boron (B): from about 0.001 to 0.010%; niobium (Nb): from about 0.05 to 0.50%; and the balance of iron (Fe) and inevitable impurities.

7 Claims, 4 Drawing Sheets

(51) Int. Cl.

| | |
|---|---|
| ***C22C 38/02*** | (2006.01) |
| ***C22C 38/04*** | (2006.01) |
| ***C22C 38/06*** | (2006.01) |
| ***C22C 38/34*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |

(52) U.S. Cl.

CPC ..... *C22C 38/06* (2013.01); *C22C 38/34* (2013.01); *C22C 38/42* (2013.01); *C22C 38/44* (2013.01); *C22C 38/46* (2013.01); *C22C 38/48* (2013.01)

(56) References Cited

U.S. PATENT DOCUMENTS

| | | | | |
|---|---|---|---|---|
| 4,796,976 | A | 1/1989 | Leslie | |
| 5,073,338 | A | 12/1991 | Furusawa et al. | |
| 5,749,228 | A | 5/1998 | Shiga et al. | |
| 6,494,970 | B1 | 12/2002 | Ishii et al. | |
| 6,681,692 | B2 * | 1/2004 | Beran | B05C 11/045 101/157 |
| 2001/0035235 | A1 | 11/2001 | Kawano | |
| 2007/0224041 | A1 | 9/2007 | Kawanaka et al. | |
| 2009/0092516 | A1 * | 4/2009 | Hashimura | C21D 9/52 420/110 |
| 2009/0291013 | A1 * | 11/2009 | Fedchun | C21D 6/004 420/91 |
| 2011/0079328 | A1 * | 4/2011 | Yokoi | C21C 7/0006 148/504 |
| 2012/0009434 | A1 * | 1/2012 | Hata | C21D 6/008 428/577 |

FOREIGN PATENT DOCUMENTS

| | | | |
|---|---|---|---|
| EP | 1 698 712 | A1 | 9/2006 |
| JP | 2-50910 | A | 2/1990 |
| JP | 2-250941 | A | 10/1990 |
| JP | 4-358040 | A | 12/1992 |
| JP | 7-150289 | A | 6/1995 |
| JP | 7-276080 | A | 10/1995 |
| JP | 8-60291 | A | 3/1996 |
| JP | H08-134547 | A | 5/1996 |
| JP | 8-209289 | A | 8/1996 |
| JP | 11-229079 | A | 8/1999 |
| JP | 2000-204434 | A | 7/2000 |
| JP | 2001-81531 | A | 3/2001 |
| JP | 4608979 | B2 | 1/2011 |
| JP | 5196934 | B2 | 5/2013 |
| JP | 5200540 | B2 | 6/2013 |
| JP | 2015-528065 | A | 9/2015 |
| JP | 2015-190026 | A | 11/2015 |
| KR | 10-0723186 | B1 | 5/2007 |
| KR | 10-2009-0016746 | A | 2/2009 |
| KR | 10-2014-0044925 | A | 4/2014 |
| KR | 10-2015-0023566 | A | 3/2015 |
| KR | 10-2015-0038426 | A | 4/2015 |
| KR | 10-1612474 | B1 | 4/2016 |
| KR | 10-2016-0096611 | A | 8/2016 |
| WO | WO 2007/074984 | A1 | 7/2007 |
| WO | WO 2013035848 | A1 | 3/2013 |
| WO | WO 2013/182621 | A1 | 12/2013 |
| WO | WO 2014/016420 | A1 | 1/2014 |
| WO | WO 2014/016421 | A1 | 1/2014 |
| WO | WO 2014/157231 | A1 | 10/2014 |
| WO | WO 2015/087224 | A1 | 6/2015 |

* cited by examiner

HIGH STRENGTH SPECIAL STEEL

CROSS REFERENCE TO RELATED APPLICATION

The present application claims under 35 U.S.C. § 119(a) the benefit of Korean Patent Application No. 10-2016-0116074, filed Sep. 9, 2016, the entire contents of which are herein incorporated by reference for all purposes.

BACKGROUND OF THE INVENTION

Technical Field

The present invention relates to a high strength special steel of which strength and fatigue life are improved by adjusting ingredients and contents to control types, sizes, and formation amounts of carbide and boride.

Description of the Related Art

Currently, a method of manufacturing a component in a hollow shape, a method using a polymer material, or the like, are been developed in the field of light weight technology. Such technology can possibly be used in a stabilizer bar applied to a chassis module, and a sub-frame, arms, or the like, applied to a drive shaft or a chassis suspension of a rally car to significantly increase fuel efficiency.

In the case of existing chassis steel, elements such as chromium (Cr), molybdenum (Mo), vanadium (V), and the like can be added to provide high strength properties. Unfortunately, a relatively simple carbide can form in a structure. The amount of the formed carbide may not be large, and its size may not be fine, thus the durability of the components may not be desirable.

In the case of high strength steel disclosed in Patent Document No. KR 10-2016-0096611, amounts of chromium (Cr) and molybdenum (Mo) used to form carbide and boride were not sufficient, and similarly, the amount of niobium (Nb) contributing to formation of the carbide was also not sufficient, such that it was difficult to improve durability while satisfying high strength.

The contents described as the related art have been provided only for assisting in the understanding for the background of the present invention and should not be considered as corresponding to the related art known to those skilled in the art.

SUMMARY OF THE INVENTION

An object of the present invention is to provide a high strength special steel of which strength and fatigue life are improved by adjusting ingredients and contents to control types, sizes, and formation amounts of carbide and boride.

According to an exemplary embodiment of the present invention, there is provided a high strength special steel containing, by weight %: carbon (C): from about 0.1 to 0.5%; silicon (Si): from about 0.1 to 2.3%; manganese (Mn): from about 0.3 to 1.5%; chromium (Cr): from about 1.1 to 4.0%; molybdenum (Mo): from about 0.3 to 1.5%; nickel (Ni): from about 0.1 to 4.0%; vanadium (V): from about 0.01 to 0.50%; boron (B): from about 0.001 to 0.010%; niobium (Nb): from about 0.05 to 0.50%; and the balance of iron (Fe) and inevitable impurities.

(V,Fe)C type and (Nb,Cr)C type composite carbides may exist in a structure.

A $(Fe,Cr)_7C_3$ type composite carbide may exist in a structure.

A $(Fe,Cr,Mo)_{23}C_6$ type composite carbide may exist in a structure.

A $(Mo,Fe)_3B_2$ type boride may exist in a structure.

A mole fraction of a precipitate existing in a structure may be from about 0.009 or more.

A size of the precipitate existing in the structure may be from about 3.5 nm or less.

The high strength special steel may have tensile strength of from about 1563 MPa or more and fatigue life of about 570,000 cycles or more.

DESCRIPTION OF THE EXEMPLARY EMBODIMENTS

Figure 1:
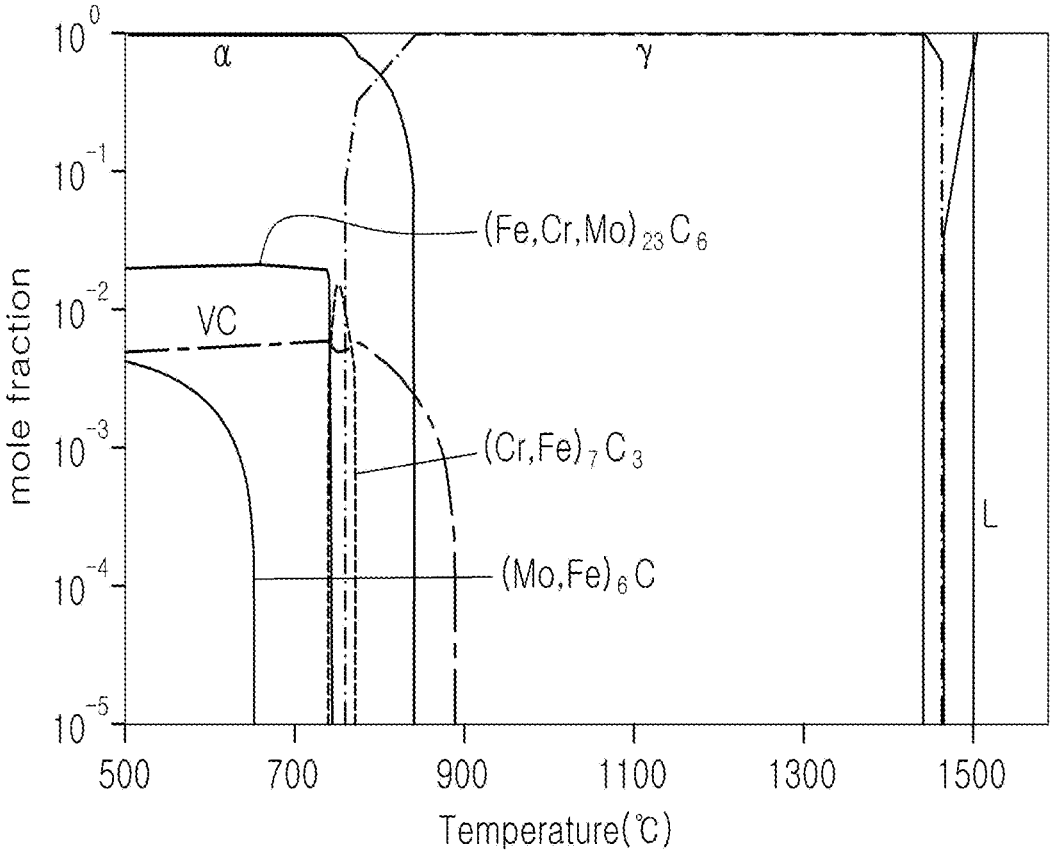
FIG. 1 is a graph illustrating a temperature-dependent change in mole fraction of a phase of an existing material.

Hereinafter, an exemplary embodiment of the present invention will be described with reference to the accompanying drawings.

Exemplary embodiments of a high strength special steel according to the present invention contains, by weight %: carbon (C): from about 0.1 to 0.5% (e.g., about 0.1%, 0.2, 0.3, 0.4, or about 0.5%); silicon (Si): from about 0.1 to 2.3% (e.g., about 0.1%, 0.2, 0.3, 0.4, 0.5, 0.6, 0.7, 0.8, 0.9, 1, 1.1, 1.2, 1.3, 1.4, 1.5, 1.6, 1.7, 1.8, 1.9, 2, 2.1, 2.2, or about 2.3%); manganese (Mn): from about 0.3 to 1.5% (e.g., about 0.3%, 0.4, 0.5, 0.6, 0.7, 0.8, 0.9, 1, 1.1, 1.2, 1.3, 1.4, or about 1.5%); chromium (Cr): from about 1.1 to 4.0% (e.g., about 1.1%, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, or about 4.0%); molybdenum (Mo): from about 0.3 to 1.5% (e.g., about 0.3%, 0.4, 0.5, 0.6, 0.7, 0.8, 0.9, 1.0, 1.1%, 1.2, 1.3, 1.4, or about 1.5%); nickel (Ni): from about 0.1 to 4.0% (e.g., about 0.1%, 0.2, 0.3, 0.4, 0.5, 0.6, 0.7, 0.8, 0.9, 1, 1.1%, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, or about 4.0%); vanadium (V): from about 0.01 to 0.50% (e.g., about 0.01%, 0.02, 0.03, 0.04, 0.05, 0.06, 0.07, 0.08, 0.09, 0.10, 0.11, 0.12, 0.13, 0.14, 0.15, 0.16, 0.17, 0.18, 0.19, 0.20, 0.21, 0.22, 0.23, 0.24, 0.25, 0.26, 0.27, 0.28, 0.29, 0.30, 0.31, 0.32, 0.33, 0.34, 0.35, 0.36, 0.37, 0.38, 0.39, 0.40, 0.41, 0.42, 0.43, 0.44, 0.45, 0.46, 0.47, 0.48, 0.49, or about 0.50%); boron (B): from about 0.001 to 0.010% (e.g., about 0.001%, 0.002, 0.003, 0.004, 0.005, 0.006, 0.007, 0.008, 0.009, or about 0.010%); niobium (Nb): from about 0.05 to 0.50% (e.g., about 0.05%, 0.06, 0.07, 0.08, 0.09, 0.10, 0.11, 0.12, 0.13, 0.14, 0.15, 0.16, 0.17, 0.18, 0.19, 0.20, 0.21, 0.22, 0.23, 0.24, 0.25, 0.26, 0.27, 0.28, 0.29, 0.30, 0.31, 0.32, 0.33, 0.34, 0.35, 0.36, 0.37, 0.38, 0.39, 0.40, 0.41, 0.42, 0.43, 0.44, 0.45, 0.46, 0.47, 0.48, 0.49, or about 0.50%); and the balance of iron (Fe) and inevitable impurities.

Hereinafter, in the high strength special steel according to the present invention, the reason of limiting ingredient conditions of the steel will be described in detail.

Carbon (C): from about 0.1 to about 0.5% (e.g., about 0.1%, 0.2, 0.3, 0.4, or about 0.5%)

Carbon (C) serves to improve strength and hardness. Carbon (C) stabilizes remaining austenite and forms composite carbides such as (V,Fe)C, $(Fe,Cr)_7C_3$, $(Fe,Cr,Mo)_{23}C_6$, and the like. In addition, carbon improves temper-resistance.

In the case in which a content of carbon (C) is less than 0.1%, an effect of improving strength is not sufficient, and fatigue strength is deteriorated. On the contrary, in the case in which the content of carbon (C) is more than 0.5%, large-sized carbide that is not dissolved remains, such that fatigue characteristics are deteriorated, and a durability life is decreased. Further, processability before quenching is also deteriorated. Therefore, the content of carbon (C) is limited in a range of from about 0.1 to 0.5% (e.g., about 0.1%, 0.2, 0.3, 0.4, or about 0.5%).

Silicon (Si): from about 0.1 to about 2.3% (e.g., about 0.1%, 0.2, 0.3, 0.4, 0.5, 0.6, 0.7, 0.8, 0.9, 1, 1.1, 1.2, 1.3, 1.4, 1.5, 1.6, 1.7, 1.8, 1.9, 2, 2.1, 2.2, or about 2.3%)

Silicon (Si) serves to improve elongation. Further, silicon (Si) hardens ferrite and martensite structures and improves heat resistance and hardenability. Silicon (Si) improves shape invariance and heat resistance but is sensitive to decarbonization.

In the case in which a content of silicon (Si) is less than 0.1%, an effect of improving elongation is insufficient. Further, an effect of improving heat resistance and hardenability is not large. On the contrary, in the case in which the content of silicon (Si) is more than 2.3%, decarbonization may occur due to an interpenetration reaction between carbon and a silicon structure. In addition, processability is deteriorated due to an increase in hardness before quenching. Therefore, the content of silicon (Si) is limited in a range of from about 0.1 to about 2.3% (e.g., about 0.1%, 0.2, 0.3, 0.4, 0.5, 0.6, 0.7, 0.8, 0.9, 1, 1.1, 1.2, 1.3, 1.4, 1.5, 1.6, 1.7, 1.8, 1.9, 2, 2.1, 2.2, or about 2.3%).

Manganese (Mn): from about 0.3 to about 1.5% (e.g., about 0.3%, 0.4, 0.5, 0.6, 0.7, 0.8, 0.9, 1, 1.1, 1.2, 1.3, 1.4, or about 1.5%)

Manganese (Mn) serves to improve hardenability and strength. Manganese is solid-dissolved in a matrix to improve bending fatigue strength and a quenching property and suppress formation of an inclusion such as $Al_2O_3$ as a deoxidizer generating an oxide. On the other hand, in the case in which an excessive amount of manganese is contained, a MnS inclusion is formed, such that high-temperature brittleness occurs.

In the case in which a content of manganese (Mn) is less than 0.3%, an effect of improving the quenching property is insufficient. On the contrary, in the case in which the content of manganese (Mn) is more than 1.5%, processability before quenching is deteriorated, and a fatigue life is decreased by center segregation and precipitation of the MnS inclusion. Therefore, the content of manganese (Mn) is limited in a range of 0.3 to 1.5% (e.g., about 0.3%, 0.4, 0.5, 0.6, 0.7, 0.8, 0.9, 1, 1.1, 1.2, 1.3, 1.4, or about 1.5%).

Chromium (Cr): from about 1.1 to about 4.0% (e.g., about 1.1%, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, or about 4.0%)

Chromium (Cr) is dissolved in an austenite structure, forms a Cr carbide at the time of tempering, and serves to improve hardenability, improve strength by suppressing the softening, and contribute to grain refinement.

In the case in which a content of chromium (Cr) is less than 1.1%, an effect of improving strength and hardenability is not large. However, in the case in which the content of the chromium (Cr) is more than 4.0%, formation of various kinds of carbides is suppressed, and the effect caused by an increase in content of chromium (Cr) is saturated, thereby resulting in an increase in cost. Therefore, the content of chromium (Cr) is limited in a range of 1.1 to 4.0% (e.g., about 1.1%, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, or about 4.0%).

Molybdenum (Mo): from about 0.3% to about 1.5% (e.g., about 0.3%, 0.4, 0.5, 0.6, 0.7, 0.8, 0.9, 1.0, 1.1%, 1.2, 1.3, 1.4, or about 1.5%)

Molybdenum (Mo) serves to form a fine precipitate to improve strength, and improve heat resistance and fracture toughness. In addition, molybdenum (Mo) improves temper-resistance.

In the case in which a content of molybdenum (Mo) is less than 0.3%, an effect of improving strength and fracture toughness is not large. On the contrary, in the case in which the content of molybdenum (Mo) is more than 1.5%, the effect of improving strength caused by an increase in content of molybdenum (Mo) is saturated, thereby resulting in an increase in cost. Therefore, the content of molybdenum (Mo) is limited in a range of from about 0.3% to about 1.5% (e.g., about 0.3%, 0.4, 0.5, 0.6, 0.7, 0.8, 0.9, 1, 1.1, 1.2, 1.3, 1.4, or about 1.5%).

Nickel (Ni): from about 0.1 to about 4.0% (e.g., about 0.1%, 0.2, 0.3, 0.4, 0.5, 0.6, 0.7, 0.8, 0.9, 1.0, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, or about 4.0%)

Nickel (Ni) serves to improve corrosion resistance, heat resistance, and hardenability, and prevent low-temperature brittleness. Nickel (Ni) is an element stabilizing austenite and expanding a high-temperature region.

In the case in which a content of nickel (Ni) is less than 0.1%, an effect of improving corrosion resistance and high-temperature stability is not large. On the contrary, in the case in which the content of nickel (Ni) is more than 4.0%, red brittleness may occur. Therefore, the content of nickel (Ni) is limited in a range of from about 0.1 to about 4.0% (e.g., about 0.1%, 0.2, 0.3, 0.4, 0.5, 0.6, 0.7, 0.8, 0.9, 1.0, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, or about 4.0%).

Vanadium (V): 0.01 to 0.50% (e.g., about 0.01%, 0.02, 0.03, 0.04, 0.05, 0.06, 0.07, 0.08, 0.09, 0.10, 0.11, 0.12, 0.13, 0.14, 0.15, 0.16, 0.17, 0.18, 0.19, 0.20, 0.21, 0.22, 0.23, 0.24, 0.25, 0.26, 0.27, 0.28, 0.29, 0.30, 0.31, 0.32, 0.33, 0.34, 0.35, 0.36, 0.37, 0.38, 0.39, 0.40, 0.41, 0.42, 0.43, 0.44, 0.45, 0.46, 0.47, 0.38, 0.49, or about 0.50%)

Vanadium (V) serves to form a fine precipitate to improve fracture toughness. The fine precipitate suppresses grain boundary movement, is dissolved to thereby be solid-dissolved in vanadium at the time of austenizing, and is precipitated to generate secondary hardening at the time of tempering. However, in the case in which vanadium is excessively added, vanadium deteriorates hardness after quenching.

In the case in which a content of vanadium (V) is less than 0.01%, an effect of improving strength and fracture toughness is not large. On the contrary, in the case in which the content of vanadium (V) is more than 0.50%, processability is significantly deteriorated, and thus, productivity is deteriorated. Therefore, the content of vanadium (V) is limited in a range of 0.01 to 0.50% (e.g., about 0.01%, 0.02, 0.03, 0.04, 0.05, 0.06, 0.07, 0.08, 0.09, 0.10, 0.11, 0.12, 0.13, 0.14, 0.15, 0.16, 0.17, 0.18, 0.19, 0.20, 0.21, 0.22, 0.23, 0.24, 0.25, 0.26, 0.27, 0.28, 0.29, 0.30, 0.31, 0.32, 0.33, 0.34, 0.35, 0.36, 0.37, 0.38, 0.39, 0.40, 0.41, 0.42, 0.43, 0.44, 0.45, 0.46, 0.47, 0.38, 0.49, or about 0.50%).

Boron (B): from about 0.001 to about 0.010% (e.g., about 0.001%, 0.002, 0.003, 0.004, 0.005, 0.006, 0.007, 0.008, 0.009, or about 0.010%)

Boron (B) improves strength and elongation and prevents corrosion. Boron (B) improves impact resistance and hardenability and prevents deterioration of solderability and low-temperature brittleness. Boron forms boride such as $(Mo,Fe)_3B_2$, or the like.

In the case in which a content of boron (B) is less than 0.001%, strength is deteriorated, and formation of the boride is deteriorated. On the contrary, in the case in which the content of boron (B) is more than 0.010%, toughness and elongation are deteriorated, such that impact-resistance is deteriorated. Therefore, the content of boron (B) is limited in a range of 0.001 to 0.010% (e.g., about 0.001%, 0.002, 0.003, 0.004, 0.005, 0.006, 0.007, 0.008, 0.009, or about 0.010%).

Niobium (Nb): from about 0.05% to about 0.50% (e.g., about 0.05%, 0.06, 0.07, 0.08, 0.09, 0.10, 0.11, 0.12, 0.13, 0.14, 0.15, 0.16, 0.17, 0.18, 0.19, 0.20, 0.21, 0.22, 0.23, 0.24, 0.25, 0.26, 0.27, 0.28, 0.29, 0.30, 0.31, 0.32, 0.33, 0.34, 0.35, 0.36, 0.37, 0.38, 0.39, 0.40, 0.41, 0.42, 0.43, 0.44, 0.45, 0.46, 0.47, 0.48, 0.49, or about 0.50%)

Niobium (Nb) forms NbC and improves strength. Niobium may control formation rates of other carbides such as Cr carbide, VC, MoC, and the like. Niobium may refine a structure and perform a surface hardening function through nitrogenation.

In the case in which a content of niobium (Nb) is less than 0.05%, strength may be deteriorated, and heterogenization of carbide may occur. On the contrary, in the case in which the content of niobium (Nb) is more than 0.50%, formation of various kinds of carbides may be suppressed, such that VC may be mainly formed. Therefore, the content of niobium (Nb) is limited in a range of from about 0.05% to about 0.50% (e.g., about 0.05%, 0.06, 0.07, 0.08, 0.09, 0.10, 0.11, 0.12, 0.13, 0.14, 0.15, 0.16, 0.17, 0.18, 0.19, 0.20, 0.21, 0.22, 0.23, 0.24, 0.25, 0.26, 0.27, 0.28, 0.29, 0.30, 0.31, 0.32, 0.33, 0.34, 0.35, 0.36, 0.37, 0.38, 0.39, 0.40, 0.41, 0.42, 0.43, 0.44, 0.45, 0.46, 0.47, 0.48, 0.49, or about 0.50%).

In addition to the above-mentioned elements, aluminum (Al), copper (Cu), oxygen (O), and the like, may be contained as the inevitable impurities.

Aluminum (Al): from about 0.003% or less (e.g., about 0.003%, 0.002, 0.001%, or less)

Aluminum (Al) serves to improve strength and impact toughness. Aluminum may decrease addition amounts of vanadium for grain refinement and nickel for securing toughness, which are expensive elements. However, in the case in which a content of aluminum (Al) is more than 0.003%, $Al_2O_3$, which is a square-shaped large inclusion, is formed, and $Al_2O_3$ acts as a fatigue starting point, such that durability may be deteriorated. Therefore, it is proper that the content of aluminum (Al) is limited in a range of 0.003% or less (e.g., about 0.003%, 0.002, 0.001, or less).

Copper (Cu): from about 0.3% or less (e.g., about 0.3%, 0.3%, 0.1%, or less)

Copper (Cu) may serve to increase strength after tempering and improve corrosion resistance of steel similarly to nickel (Ni). However, in the case in which the content of copper (Cu) is more than 0.3%, an alloy cost is rather increased. Therefore, it is proper that the content of copper (Cu) is limited in a range of 0.3% or less.

Oxygen (O): 0.003% or less e.g., about 0.003%, 0.002, 0.001%, or less)

Oxygen (O) binds to silicon (Si) or aluminum (Al) to form a hard oxide based non-metal inclusion, thereby deteriorating fatigue life characteristics. Therefore, it is preferable that a content of oxygen (O) is maintained as low as possible. In the case in which the content of oxygen (O) is more than 0.003%, $Al_2O_3$ is formed by a reaction with aluminum (Al), and $Al_2O_3$ acts as a fatigue starting point, such that durability may be deteriorated. Therefore, it is proper that the content of oxygen (O) is limited in a range of 0.003% or less (e.g., about 0.003%, 0.002, 0.001%, or less).

EXAMPLES AND COMPARATIVE EXAMPLES

Examples and Comparative Examples based on test samples manufactured while changing composition ingredients and contents are illustrated in the following Tables 1 and 2. Test samples were tempered at about 200 or so after oil quenching at 950 to 1000° C. at the time of heat treatment were used.

TABLE 1

| wt % | Carbon (C) | Silicon (Si) | Manganese (Mn) | Chromium (Cr) | Molybdenum (Mo) | Nickel (Ni) | Vanadium (V) | Boron (B) | Niobium (Nb) | Copper (Cu) | Aluminum (Al) | Oxygen (O) |
|---|---|---|---|---|---|---|---|---|---|---|---|---|
| Example 1 | 0.31 | 0.21 | 0.72 | 1.52 | 0.52 | 2.02 | 0.17 | 0.006 | 0.28 | 0.054 | 0.0004 | 0.0002 |
| Example 2 | 0.13 | 0.13 | 0.33 | 1.13 | 0.33 | 0.15 | 0.04 | 0.002 | 0.09 | 0.067 | 0.0005 | 0.0018 |
| Example 3 | 0.47 | 2.26 | 1.47 | 3.94 | 1.47 | 3.96 | 0.48 | 0.009 | 0.48 | 0.035 | 0.0011 | 0.0005 |
| Existing Material | 0.15 | 0.15 | 1.00 | 1.50 | 0.90 | — | 0.25 | — | — | 0.062 | 0.0013 | 0.0016 |
| Comparative Example 1 | 0.09 | 0.21 | 0.76 | 1.53 | 0.54 | 1.98 | 0.26 | 0.004 | 0.08 | 0.042 | 0.0006 | 0.0004 |
| Comparative Example 2 | 0.52 | 0.18 | 0.35 | 2.15 | 0.37 | 0.36 | 0.34 | 0.008 | 0.23 | 0.043 | 0.0012 | 0.0020 |
| Comparative Example 3 | 0.34 | 0.08 | 1.42 | 3.76 | 1.35 | 3.32 | 0.46 | 0.005 | 0.35 | 0.050 | 0.0020 | 0.0010 |
| Comparative Example 4 | 0.16 | 2.31 | 0.83 | 1.52 | 0.61 | 2.54 | 0.18 | 0.002 | 0.44 | 0.034 | 0.0010 | 0.0016 |
| Comparative Example 5 | 0.47 | 0.26 | 0.27 | 2.53 | 0.41 | 0.46 | 0.41 | 0.007 | 0.16 | 0.040 | 0.0009 | 0.0001 |
| Comparative Example 6 | 0.38 | 0.58 | 1.53 | 3.94 | 1.45 | 3.77 | 0.40 | 0.004 | 0.09 | 0.053 | 0.0011 | 0.0016 |
| Comparative Example 7 | 0.20 | 1.94 | 0.93 | 1.08 | 0.63 | 2.35 | 0.18 | 0.008 | 0.21 | 0.065 | 0.0018 | 0.0017 |
| Comparative Example 8 | 0.47 | 0.22 | 0.43 | 4.10 | 1.42 | 0.84 | 0.16 | 0.005 | 0.35 | 0.041 | 0.0005 | 0.0010 |

TABLE 1-continued

| wt % | Carbon (C) | Silicon (Si) | Manganese (Mn) | Chromium (Cr) | Molybdenum (Mo) | Nickel (Ni) | Vanadium (V) | Boron (B) | Niobium (Nb) | Copper (Cu) | Aluminum (Al) | Oxygen (O) |
|---|---|---|---|---|---|---|---|---|---|---|---|---|
| Comparative Example 9 | 0.36 | 0.37 | 1.45 | 3.54 | 0.28 | 3.86 | 0.45 | 0.002 | 0.41 | 0.044 | 0.0004 | 0.0015 |
| Comparative Example 10 | 0.14 | 1.75 | 1.26 | 1.15 | 1.53 | 2.64 | 0.21 | 0.008 | 0.16 | 0.051 | 0.0020 | 0.0023 |
| Comparative Example 11 | 0.43 | 0.23 | 0.54 | 3.96 | 0.57 | 0.07 | 0.34 | 0.004 | 0.09 | 0.061 | 0.0010 | 0.0014 |
| Comparative Example 12 | 0.33 | 1.24 | 1.47 | 1.54 | 0.46 | 4.20 | 0.49 | 0.006 | 0.32 | 0.041 | 0.0014 | 0.0002 |
| Comparative Example 13 | 0.73 | 1.36 | 0.76 | 2.36 | 1.25 | 1.46 | 0.009 | 0.005 | 0.36 | 0.063 | 0.0017 | 0.0008 |
| Comparative Example 14 | 0.46 | 0.26 | 0.78 | 3.98 | 0.77 | 1.93 | 0.51 | 0.002 | 0.42 | 0.062 | 0.0010 | 0.0009 |
| Comparative Example 15 | 0.32 | 1.75 | 0.561 | 1.56 | 0.64 | 2.51 | 0.45 | 0.0008 | 0.09 | 0.065 | 0.0020 | 0.0023 |
| Comparative Example 16 | 0.18 | 0.26 | 1.43 | 2.38 | 1.43 | 0.47 | 0.19 | 0.012 | 0.24 | 0.042 | 0.0008 | 0.0016 |
| Comparative Example 17 | 0.26 | 0.28 | 1.48 | 1.15 | 0.46 | 0.31 | 0.26 | 0.007 | 0.04 | 0.040 | 0.0006 | 0.0010 |
| Comparative Example 18 | 0.49 | 0.37 | 1.23 | 3.93 | 1.42 | 3.32 | 0.28 | 0.005 | 0.51 | 0.043 | 0.0010 | 0.0015 |

TABLE 2

| | Tensile Strength (MPa) | Hardness (HV) | Fatigue Strength (MPa) | Fatigue Life |
|---|---|---|---|---|
| Example 1 | 1563 | 553 | 1189 | 590,000 cycles |
| Example 2 | 1577 | 543 | 1183 | 570,000 cycles |
| Example 3 | 1565 | 539 | 1186 | 580,000 cycles |
| Existing Material | 982 | 343 | 691 | 270,000 cycles |
| Comparative Example 1 | 1162 | 374 | 859 | 260,000 cycles |
| Comparative Example 2 | 1573 | 532 | 1143 | 240,000 cycles |
| Comparative Example 3 | 1266 | 424 | 968 | 230,000 cycles |
| Comparative Example 4 | 1521 | 469 | 1135 | 280,000 cycles |
| Comparative Example 5 | 1363 | 454 | 1035 | 420,000 cycles |
| Comparative Example 6 | 1418 | 466 | 1125 | 240,000 cycles |
| Comparative Example 7 | 1182 | 401 | 837 | 250,000 cycles |
| Comparative Example 8 | 1488 | 478 | 1105 | 330,000 cycles |
| Comparative Example 9 | 1306 | 443 | 953 | 310,000 cycles |
| Comparative Example 10 | 1545 | 512 | 1142 | 370,000 cycles |
| Comparative Example 11 | 1285 | 444 | 834 | 230,000 cycles |
| Comparative Example 12 | 1346 | 457 | 805 | 250,000 cycles |
| Comparative Example 13 | 1285 | 436 | 968 | 280,000 cycles |
| Comparative Example 14 | 1476 | 482 | 1104 | 370,000 cycles |
| Comparative Example 15 | 1491 | 463 | 1101 | 310,000 cycles |
| Comparative Example 16 | 1318 | 388 | 966 | 300,000 cycles |
| Comparative Example 17 | 1418 | 479 | 1004 | 240,000 cycles |
| Comparative Example 18 | 1183 | 443 | 884 | 210,000 cycles |

Table 1 indicates composition ingredients and contents of the Examples and Comparative Examples. In addition, Table 2 indicates tensile strength, hardness, fatigue strength, and fatigue life of the Examples and Comparative Examples.

The tensile strength and yield strength were measured according to KS B 0802 or ISO 6892, the hardness was measured according to KS B 0811 or ISO 1143, and the fatigue life was measured according to KS B ISO 1143.

In Comparative Examples 1 and 2, contents of other ingredients were controlled in the same ranges as those in the Examples within the limited range of the high-strength special steel according to the present invention, but a content of only carbon (C) was controlled to be below or above the limited range of the high-strength special steel according to the present invention.

As illustrated in Table 2, it was shown that in the case in which the content of carbon (C) was below the range, tensile strength, hardness, fatigue strength, and fatigue life were deteriorated as compared to Examples. In the case in which the content of carbon (C) was above the range, fatigue life was deteriorated as compared to the Examples.

In Comparative Examples 3 and 4, contents of other ingredients were controlled in the same ranges as those in the Examples within the limited range of the high-strength special steel according to the present invention, but a content of only silicon (Si) was controlled to be below or above the limited range of the high-strength special steel according to the present invention.

As illustrated in Table 2, it was shown that in the case in which the content of silicon (Si) was below the range, tensile strength, hardness, fatigue strength, and fatigue life were deteriorated as compared to Examples. In the case in which the content of silicon (Si) was above the range, fatigue life was deteriorated as compared to the Examples.

In Comparative Examples 5 and 6, contents of other ingredients were controlled in the same ranges as those in the Examples within the limited range of the high-strength special steel according to the present invention, but a content of only manganese (Mn) was controlled to be below or above the limited range of the high-strength special steel according to the present invention.

As illustrated in Table 2, it was shown that in the case in which the content of manganese (Mn) was below the range, tensile strength, hardness, fatigue strength, and fatigue life were deteriorated as compared to the Examples. In the case in which the content of manganese (Mn) was above the range, tensile strength, hardness, and fatigue life were deteriorated as compared to Examples.

In Comparative Examples 7 and 8, contents of other ingredients were controlled in the same ranges as those in the Examples within the limited range of the high-strength special steel according to the present invention, but a content of only chromium (Cr) was controlled to be below or above the limited range of the high-strength special steel according to the present invention.

As illustrated in Table 2, it was shown that in the case in which the content of chromium (Cr) was below the range, tensile strength, hardness, fatigue strength, and fatigue life were deteriorated as compared to the Examples. In the case in which the content of chromium (Cr) was above the range, tensile strength, hardness, and fatigue life were deteriorated as compared to the Examples.

In Comparative Examples 9 and 10, contents of other ingredients were controlled in the same ranges as those in the Examples within the limited range of the high-strength special steel according to the present invention, but a content of only molybdenum (Mo) was controlled to be below or above the limited range of the high-strength special steel according to the present invention.

As illustrated in Table 2, it was shown that in the case in which the content of molybdenum (Mo) was below the range, tensile strength, hardness, fatigue strength, and fatigue life were deteriorated as compared to the Examples. In the case in which the content of molybdenum (Mo) was above the range, fatigue life was deteriorated as compared to the Examples.

In Comparative Examples 11 and 12, contents of other ingredients were controlled in the same ranges as those in the Examples within the limited range of the high-strength special steel according to the present invention, but a content of only nickel (Ni) was controlled to be below or above the limited range of the high-strength special steel according to the present invention.

As illustrated in Table 2, it was shown that in the case in which the content of nickel (Ni) was below the range and the case in which the content of nickel (Ni) was above the range, tensile strength, hardness, fatigue strength, and fatigue life were deteriorated as compared to the Examples.

In Comparative Examples 13 and 14, contents of other ingredients were controlled in the same ranges as those in the Examples within the limited ranges of the high-strength special steel according to the present invention, but a content of only vanadium (V) was controlled to be below or above the limited range of the high-strength special steel according to the present invention.

As illustrated in Table 2, it was shown that in the case in which the content of vanadium (V) was below the range, tensile strength, hardness, fatigue strength, and fatigue life were deteriorated as compared to the Examples. In the case in which the content of vanadium (V) was above the range, tensile strength, hardness, and fatigue life were deteriorated as compared to the Examples.

In Comparative Examples 15 and 16, contents of other ingredients were controlled in the same ranges as those in the Examples within the limited range of the high-strength special steel according to the present invention, but a content of only boron (B) was controlled to be below or above the limited range of the high-strength special steel according to the present invention.

As illustrated in Table 2, it was shown that in the case in which the content of boron (B) was below the range, tensile strength, hardness, and fatigue life were deteriorated as compared to the Examples, and in the case in which the content of boron (B) was above the range, tensile strength, hardness, fatigue strength, and fatigue life were deteriorated as compared to the Examples.

In Comparative Examples 17 and 18, contents of other ingredients were controlled in the same ranges as those in the Examples within the limited range of the high-strength special steel according to the present invention, but a content of only niobium (Nb) was controlled to be below or above the limited range of the high-strength special steel according to the present invention.

As illustrated in Table 2, it was shown that in the case in which the content of niobium (Nb) was below the range and the case in which the content of niobium (Nb) was above the range, tensile strength, hardness, fatigue strength, and fatigue life were deteriorated as compared to the Examples.

Hereinafter, the high strength special steel according to the present invention will be described with reference to FIGS. 1 to 4.

FIG. 1 provides a graph illustrating a thermodynamics-based calculation result of an alloy ingredient, 0.15C-0.15Si-1.0Mn-1.5Cr-0.9Mo-0.25V (number in front of element symbol: wt %) as an existing material, illustrates a temperature dependent change in mole fraction.

Figure 2:
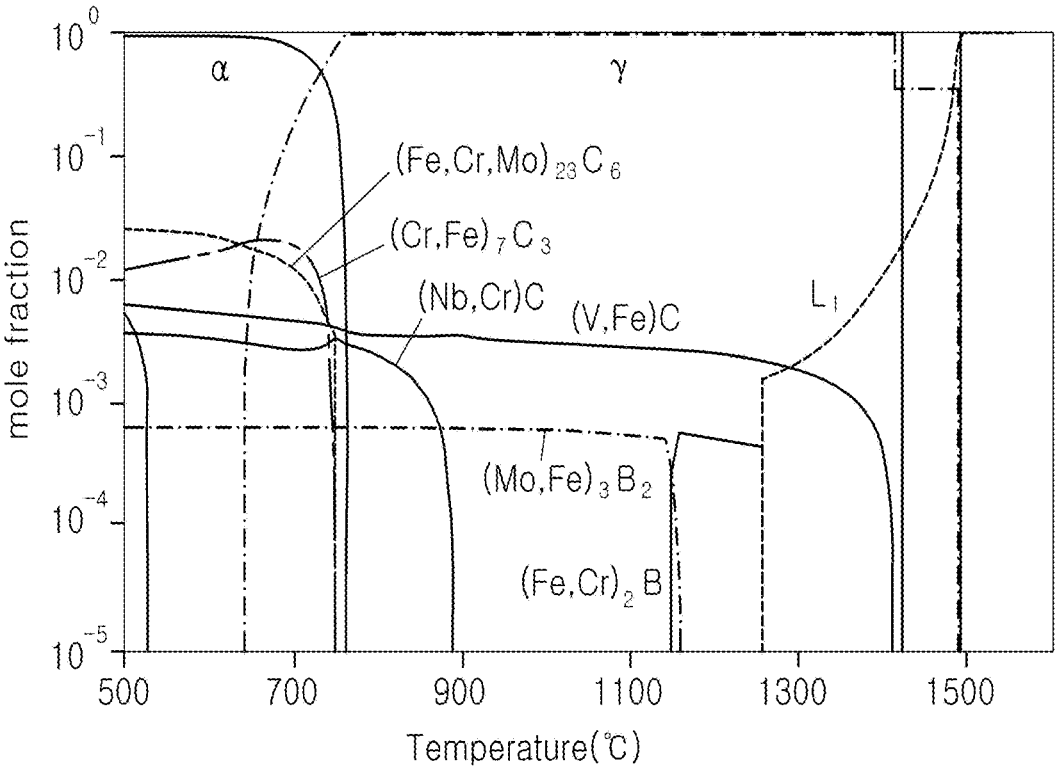
FIG. 2 is a graph illustrating a temperature-dependent change in mole fraction of a phase in Example according to the present invention.

FIG. 2 provides a graph illustrating a thermodynamics-based calculation result of an alloy ingredient, 0.3C-0.2Si-0.7Mn-1.5Cr-2.0Ni-0.5Mo-0.15V-0.005B-0.25Nb (number in front of element symbol: wt %) as in the Example of the high strength special steel according to the present invention, illustrates a temperature-dependent change in mole fraction.

At the time of comparing the results of FIGS. 1 and 2, it may be appreciated that carbon (C) and nickel (Ni) corresponding to an element stabilizing austenite were excessively contained as compared to the existing material, such that A1 and A3 temperatures were decreased, and thus, an austenite region was expanded.

Unlike the existing material in which a VC carbide exists in a structure, a (V,Fe)C type carbide was precipitated in a structure to thereby be formed in a form of composite carbide. The (V,Fe)C type carbide was formed from the austenite region, such that the carbide was formed to have a small size and high distribution. Meanwhile, (Nb,Cr)C was formed together with chromium (Cr) from a ferrite region due to addition of niobium (NB) corresponding to a strong carbide formation element, such that a large amount of composite carbide in a stable form was present at a high temperature. Precipitation means that another solid phase is newly formed in a solid phase.

As the composite carbide with a small size was uniformly distributed in the structure, fatigue life in addition to strength may be improved, which is illustrated in Table 2.

Unlike the existing material in which a $(Cr,Fe)_7C_3$ type carbide was formed in the structure and then disappeared at a temperature of 500° C. or less, the $(Cr,Fe)_7C_3$ type carbide was precipitated in the structure even at a temperature of 500° C. or less to thereby be formed in a form of composite carbide. A temperature region in which the carbide was formed was high as compared to the existing material, such that the carbide was formed in a stable state, and similarly, the carbide had a small size to thereby be uniformly distributed in the structure, such that fatigue life in addition to strength may be improved, which is illustrated in Table 2.

Unlike the existing material in which a $(Mo,Fe)_6C$ type carbide was formed in a low temperature region in the structure, since a content of molybdenum (Mo) was small, the $(Mo,Fe)_6C$ type carbide was not formed in a low temperature region. Rather, a $(Fe,Cr,Mo)_{23}C_6$ type carbide was precipitated to thereby be formed in a form of composite carbide.

The $(Mo,Fe)_6C$ type carbide formed in the low temperature region was unstable, such that the $(Mo,Fe)_6C$ type carbide rather deteriorated strength and fatigue life. However, as shown in the Example, molybdenum (Mo) forms a boride from the austenite region, and then forms $(Fe,Cr,Mo)_{23}C_6$, thereby forming a stable composite carbide. Therefore, formation of the $(Mo,Fe)_6C$ type carbide was suppressed due to lack of molybdenum (Mo) in a low temperature region, such that fatigue life in addition to strength may be improved.

Meanwhile, unlike the existing material, boron (B) was added, such that borides such as $(Fe,Cr)_2B$, $(Mo,Fe)_3B_2$, and the like, may be precipitated in the structure. In view of thermodynamics, $(Fe,Cr)_2B$ may be formed and then disappear. $(Mo,Fe)_3B_2$ may remain in the structure even at 500° C. or less to improve strength and fatigue life.

Figure 3:
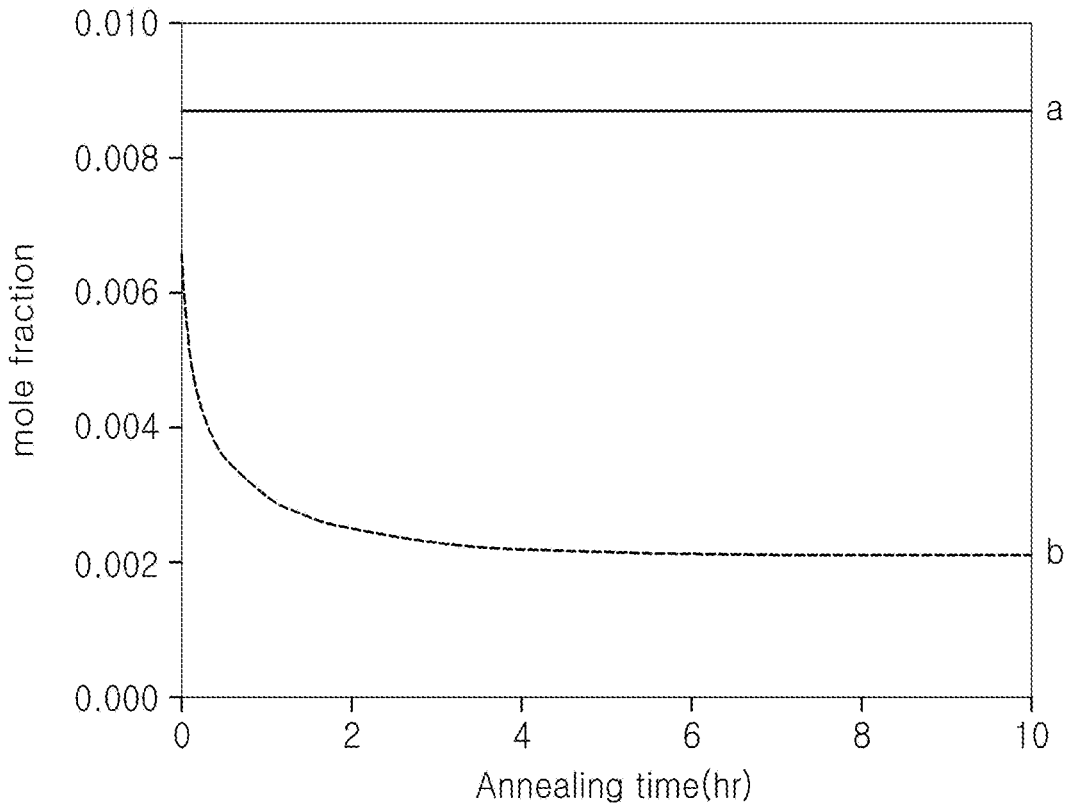
FIG. 3 is a graph illustrating a time-dependent change in mole fraction of precipitates in Examples of the present invention.

FIG. 3 is a graph illustrating an annealing time-dependent change in mole fraction of a precipitate containing carbide and boride. As shown in the Example, it was shown that based on an annealing time of 10 hours, a mole fraction of the precipitate was 0.009 or more as in the point represented by a. A significantly large amount of precipitate was formed as compared to the existing material in which a mole fraction of the precipitate was only 0.002 as in the point represented by b. Therefore, fatigue life in addition to strength may be improved as described above. The mole fraction means a mole fraction of the precipitate in an entire structure, and the mole fraction of the precipitate in Example may be expressed as 0.9% in terms of %.

Figure 4:
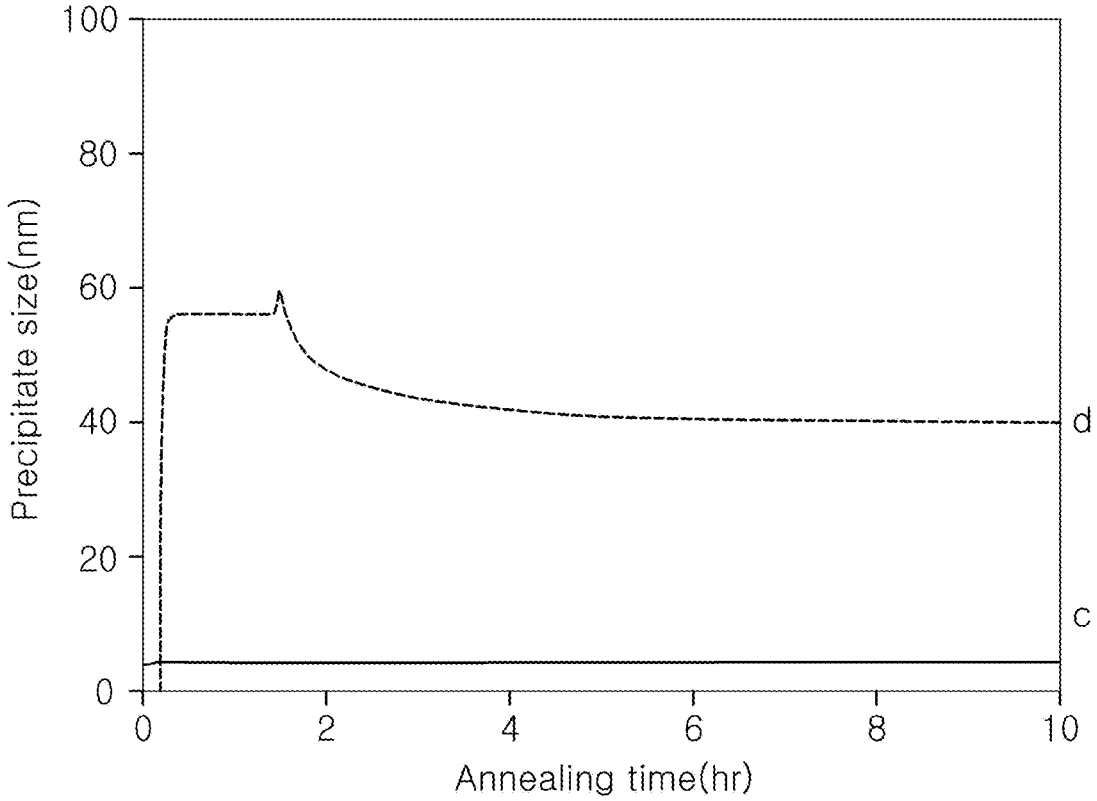
FIG. 4 is a graph illustrating a time-dependent change in size of the precipitates in Examples of the present invention.

FIG. 4 is a graph illustrating an annealing time-dependent change in size of a precipitate containing carbide and boride. In the Example it was shown that based on an annealing time of 10 hours, unlike the existing material in which a precipitate having a size of 40 nm or more was formed as in the point represented by c, a precipitate having a size of 3.5 nm or less was formed as in the point represented by d. Therefore, similarly, strength and fatigue life may be improved.

In the high strength special steel according to the present invention, strength and fatigue life may be improved by controlling the contents of the elements to form the carbide and boride in the structure as described above.

Tensile strength may be improved by about 59% as compared to the existing material. In the case in which the high strength special steel is applied to a component of a vehicle to thereby be applied in a vehicle body, the vehicle body may be lightened by about 34%, making it possible improve fuel efficiency. Fatigue strength may be increased by about 71%, and fatigue life may be increased by about 110%.

With the high strength special steel according to the present invention as described above, strength and fatigue life may be improved by controlling the contents of the elements to form the carbide and boride in the structure.

Although the present invention has been shown and described with respect to specific exemplary embodiments, it will be obvious to those skilled in the art that the present invention may be variously modified and altered without departing from the spirit and scope of the present invention as defined by the following claims.

What is claimed is:

1. A high strength special steel comprising, by weight%: carbon (C):

from about 0.1 to 0.5%; silicon (Si): from about 0.1 to 2.3%; manganese (Mn): from about 0.3 to 1.5%; chromium (Cr): from about 1.1 to 4.0%; molybdenum (Mo): from about 0.3 to 1.5%; nickel (Ni): from about 0.1 to 4.0%; vanadium (V): from about 0.01 to 0.50%; boron (B): from about 0.001 to 0.010%; niobium (Nb): from about 0.05 to 0.50%; Oxygen (O): from about 0.0002% to 0.003%; Aluminum (Al); from about 0.0004% to 0.003%; and the balance of iron (Fe); and inevitable impurities, wherein the high strength special steel has tensile strength of from about 1563MPa or more and fatigue life of from about 570,000 cycles or more.

2. The high strength special steel of claim 1, wherein (V,Fe)C, Nb, and/or Cr type composite carbides exist in a microstructure of the steel.

3. The high strength special steel of claim 1, wherein a $(Fe,Cr)_7C_3$ type composite carbide exists in a microstructure of the steel.

4. The high strength special steel of claim 1, wherein a $(Fe,Cr,Mo)_{23}C_6$ type composite carbide exists in a microstructure of the steel.

5. The high strength special steel of claim 1, wherein a $(Mo,Fe)_3B_2$ type boride exists in a microstructure of the steel.

6. The high strength special steel of claim 1, wherein a mole fraction of a precipitate existing in a microstructure of the steel is from about 0.009 or more.

7. The high strength special steel of claim 6, wherein a size of the precipitate existing in the microstructure of the steel is from about 3.5 nm or less.

* * * * *